US005826356A

United States Patent [19]

Lapp

[11] Patent Number: 5,826,356

[45] Date of Patent: Oct. 27, 1998

[54] RETAIL PROMOTION DISPLAY AND COUPON SYSTEM FOR FOOD AND BEVERAGE CONTAINERS

[76] Inventor: James F. Lapp, 1703 Park Ave., Richmond, Va. 23220

[21] Appl. No.: 749,183

[22] Filed: Nov. 14, 1996

Related U.S. Application Data

[63] Continuation of Ser. No. 427,429, Apr. 24, 1995, abandoned.

[51] Int. Cl.[6] ..... G09F 3/00

[52] U.S. Cl. ..... 40/310; 40/299; 229/74

[58] Field of Search ..... 40/310, 299; 229/74; 383/9, 106; 206/831; D6/560, 546

[56] References Cited

U.S. PATENT DOCUMENTS

| | | | |
|---|---|---|---|
| D. 331,016 | 11/1992 | Dinand et al. | D9/560 X |
| 1,969,428 | 8/1934 | Schwartz | 229/74 |
| 1,984,559 | 12/1934 | Wilcox | 40/310 X |
| 2,007,685 | 7/1935 | Lyle | 40/310 |
| 4,208,819 | 6/1980 | Jones et al. | 40/310 |
| 5,348,156 | 9/1994 | Maroszek et al. | 40/310 X |
| 5,419,437 | 5/1995 | Huseman | 383/9 X |

*Primary Examiner*—Cassandra Davis

[57] ABSTRACT

A promotional material display and coupon system is provided for use with a container. The container includes a top and has a footprint defined as the largest horizontal cross-section of the container in its display orientation. A central support having first and second opposing edges depends from and is balanced about the top of the container. First and second carrier sections depend repsectively from the first and second opposing edges of the central support. Both first and second carrier sections reside within the container's footprint. Each of the first and second carrier sections support within or thereon at least one piece of promotional material.

1 Claim, 11 Drawing Sheets

RETAIL PROMOTION DISPLAY AND COUPON SYSTEM FOR FOOD AND BEVERAGE CONTAINERS

This application is a continuation of application Ser. No. 08/427,429, filed Apr. 24, 1995, now abandoned.

FIELD OF THE INVENTION

The invention relates generally to retail promotion, and more particularly to a retail promotion display and coupon system that is positioned and supported on top of a food or beverage container, that does not extend beyond the footprint of the container, that can be easily removed without defacing or damage to the container, and that is designed for manual or automated affixing to the container.

BACKGROUND OF THE INVENTION

Hang tags displaying promotional material (e.g., coupons, special offers, rebates, etc.) for food and beverage containers have been used for years. The various offered promotions are a means of increasing sales of both the product displaying the hang tags and products affected by the offered promotion displayed on the hang tag.

In the case of a capped liquid container, the hang tags are traditionally hung from the top of the container and drape down the side of the container such that the tag extends beyond the outermost perimeter of the container. However, when the containers are packaged for shipping or stacked on retail shelves, the incremental bulk of the conventional hang tag must be taken into consideration. Further, when the containers are stocked on a store's shelf, the promotional value of the hang tag is reduced if tags become obscured from the consumer's vision by adjacent containers.

In the case of containers having a sealed-ridge type top (e.g., juice containers having a gabled top with a flange extending upwardly from a ridge, potato chip/pretzel bags having a sealed ridge that forms the top of the container, etc.), promotional material is typically adhered directly to the sides of the container. This again results in decreased promotional value since the promotional material is not readily visible to the consumer.

SUMMARY OF THE INVENTION

Accordingly, it is an object of the present invention to provide a promotional material display and coupon system for use with food and beverage containers.

Another object of the present invention is to provide a promotional material display and coupon system that will not require special package handling.

Still another object of the present invention is to provide a promotional material display and coupon delivery system that mounts on food and beverage containers such that the promotional material is easily viewed by the consumer even when the containers are stocked side-by-side.

Yet another object of the present invention is to provide a promotional material display and coupon system capable of holding a multiplicity of promotional materials.

Other objects and advantages of the present invention will become more obvious hereinafter in the specification and drawings.

In accordance with the present invention, a promotional material display and coupon system is provided for use with a variety of food or beverage containers. Regardless of the container's design, the container includes a top and has a footprint defined as the largest horizontal cross-section of the container in its display or upright orientation. A central support having first and second opposing edges depends from and is balanced about the top of the container. A first carrier section depending from the first opposing edge of the central support and resides within the container's footprint. A second carrier section depending from the second opposing edge of the central support and also resides within the container's footprint. Each of the first and second carrier sections support within or thereon at least one piece of promotional material.

DETAILED DESCRIPTION OF THE INVENTION

Figure 1:
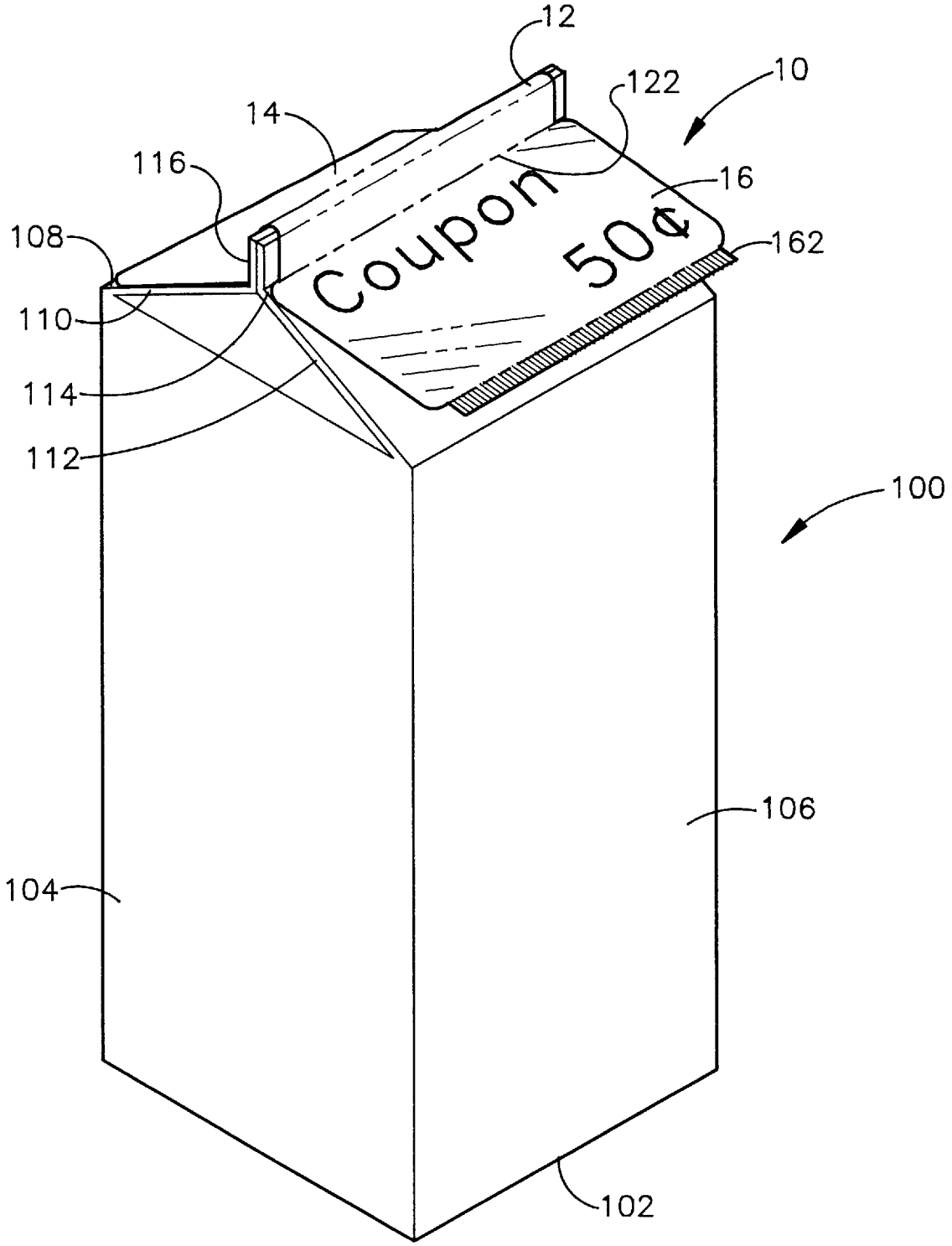
FIG. 1 is a perspective view of a gabled top container outfitted with the promotional material display system according to one embodiment of the present invention.
Figure 2:
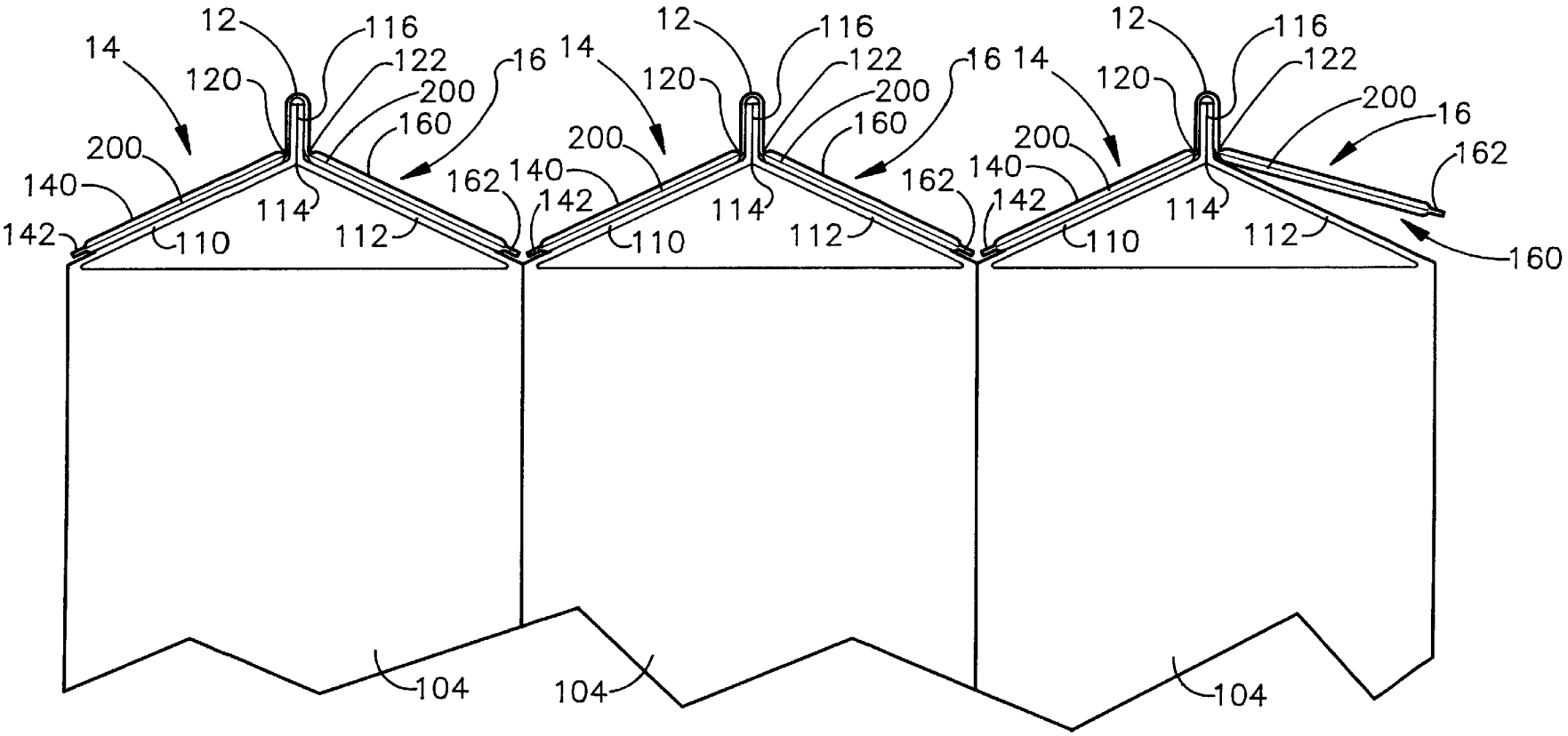
FIG. 2 is a side view of a plurality of gabled top containers, each of which is outfitted with the promotional material display system.

Referring now to the drawings, and more particularly to FIG. 1, a perspective view of gabled top container 100 is shown outfitted on top thereof with a first embodiment of promotional material display referenced generally by numeral 10. FIG. 2 shows a side view of a plurality of containers 100, each of which is outfitted with one of promotional material display 10. The same reference numerals are used for those elements in common between FIGS. 1 and 2.

Gabled top container 100 is a conventional food (e.g., candies, popcorn, etc.) or beverage (e.g., juice, milk, etc.) container well known in the art. Briefly, gabled top container has base 102 defining the amount of shelf area required to stock container 100. Four side walls (only walls 104 and 106 are visible in FIG. 1 and only wall 104 is visible in FIG. 2) extend vertically up from base 102 to gabled top 108. In terms of the present invention, the relevant portions of gabled top 108 are angled roof sections 110 and 112 that meet and are fused or adhered at ridge 114 and continue substantially upward from ridge 114 to form flange 116.

Promotional material display 10 is constructed to have central support section 12 balanced about, formed over and adhered to flange 116. Fixedly or detachably depending from edges 120 and 122 on either side of central support section 12 are, for example, transparent packets or envelopes 14 and 16. Envelopes 14 and 16 have respective openings 140 and 160 for receiving therethrough one or more pieces of printed promotional material, e.g. coupons, rebate offers, recipes, etc., represented generally in the drawings by reference numeral 200. Envelopes 14 and 16 could be made from, for example, any transparent polyethylene, polycarbonate or polyester-type film that is sealed or fused together along respective lower edges 142 and 162 to define the envelopes. Alternatively, envelopes 14 and 16 could be made from an opaque material in which case the outer surface thereof could contain a general description of what was contained in the envelope, e.g, "COUPONS", "DEAL OF THE WEEK", etc. Still another alternative (that will be described further below with respect to another embodiment) is to print the promotional material directly on a carrier that is fixedly or detachably joined to opposing edges 120 and 122 of central section 12. However, in all cases, promotional material display 10 does not extend beyond the container's footprint. The container's footprint is defined herein as the amount of area required to support a single container in its display orientation. In other words, the footprint is typically defined by the largest horizontal cross-section of container 100. In this way, promotional material display 10 will never infringe on the stocking space of an adjacent container. In addition, central support section 12 and envelopes 14 and 16 are balanced about the top of container 100. These features of the present invention are best represented in FIG. 2. Thus, promotional material display 10 provides a high degree of consumer visibility while also preventing damage to display 10 since adjacent containers cannot contact the display.

Figure 3:
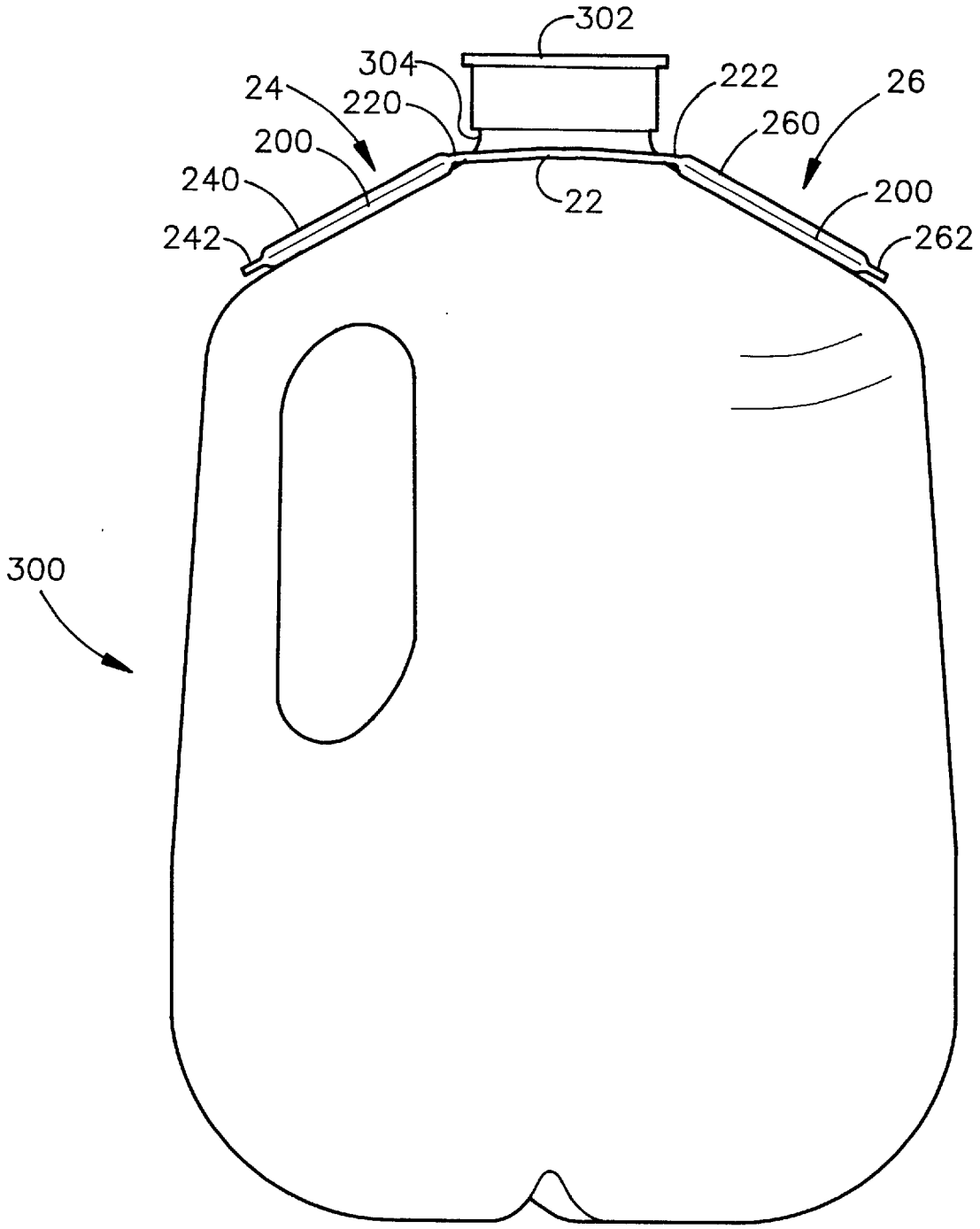
FIG. 3 is a side view of a plastic jug beverage container outfitted with the promotional material display system according to a second embodiment of the present invention.
Figure 4:
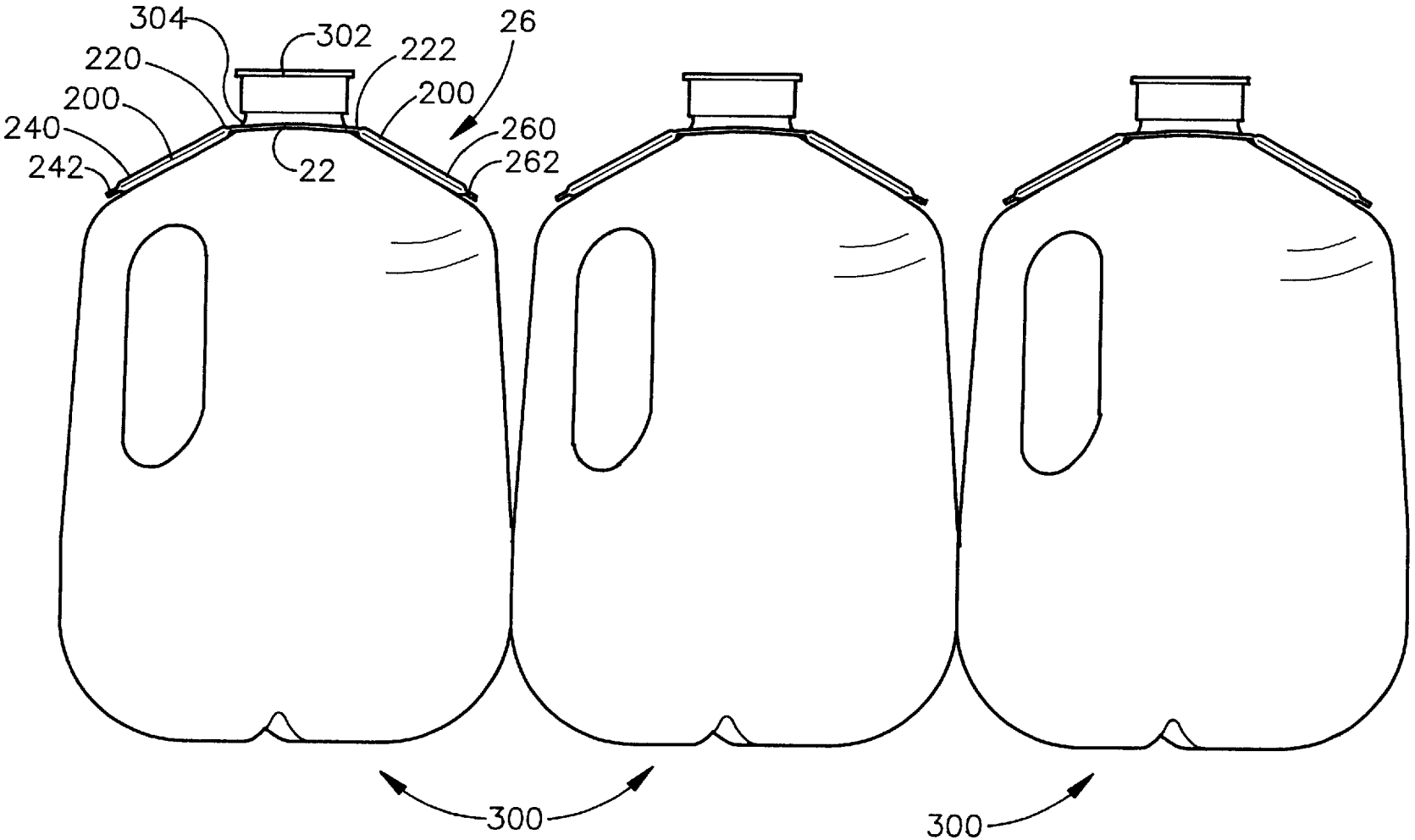
FIG. 4 is a side view of a plurality of plastic jug beverage containers, each of which is outfitted with the promotional material display system.
Figure 5:
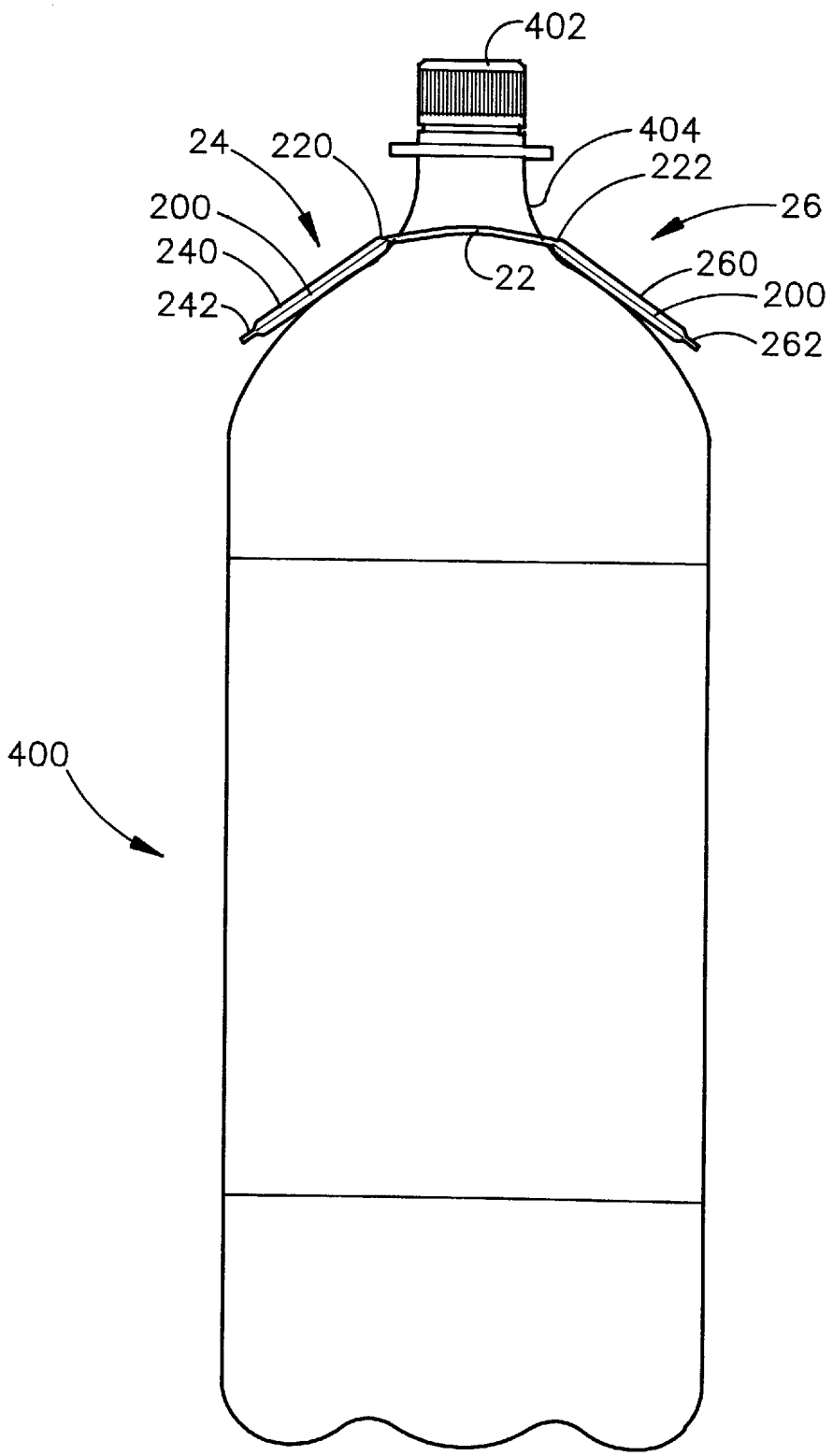
FIG. 5 is a side view of an upright-type plastic beverage container outfitted with the promotional material display system.
Figure 6:
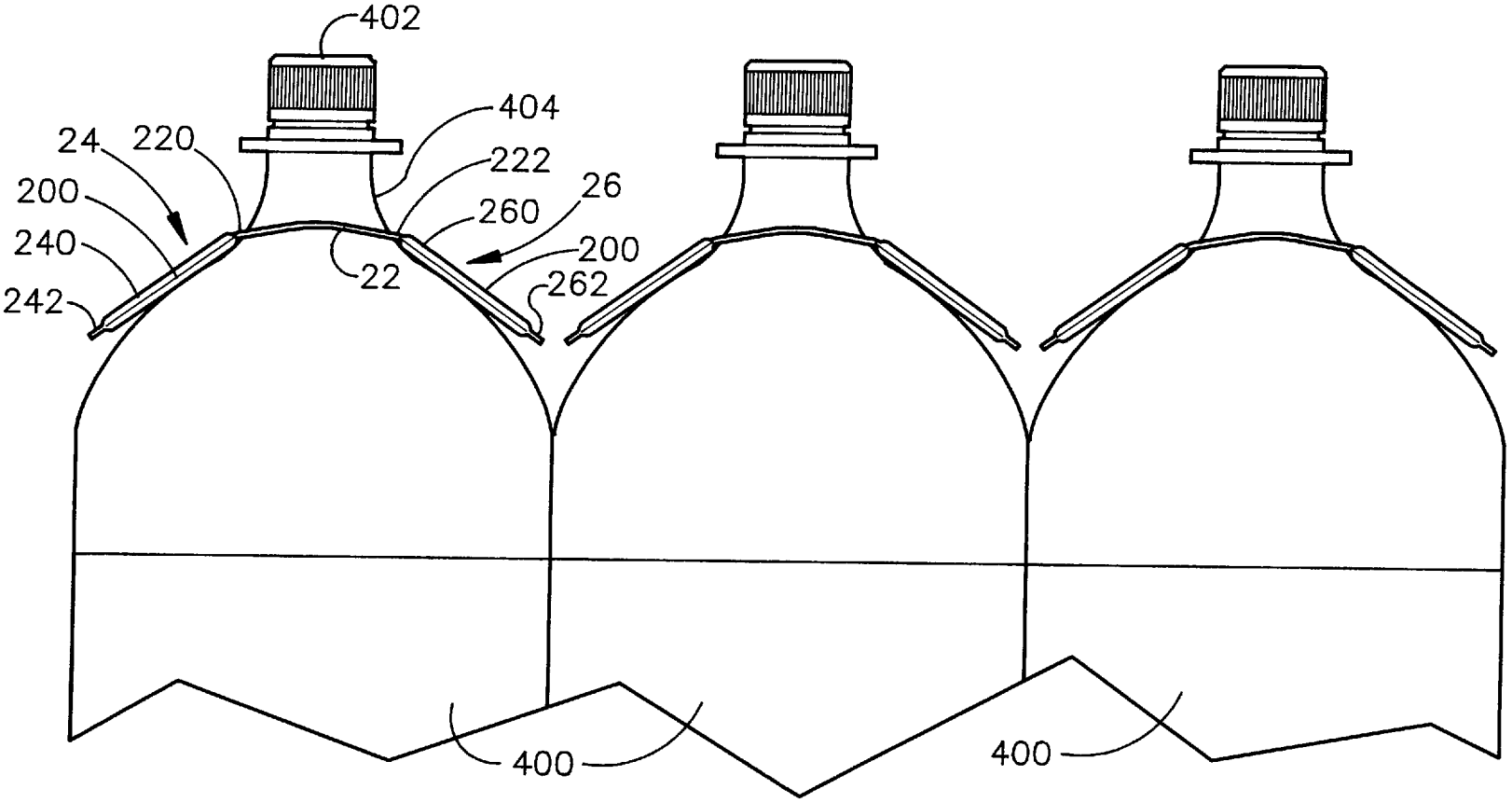
FIG. 6 is a side view of upright-type plastic beverage containers, each of which is outfitted with the promotional material display system.
Figure 7:
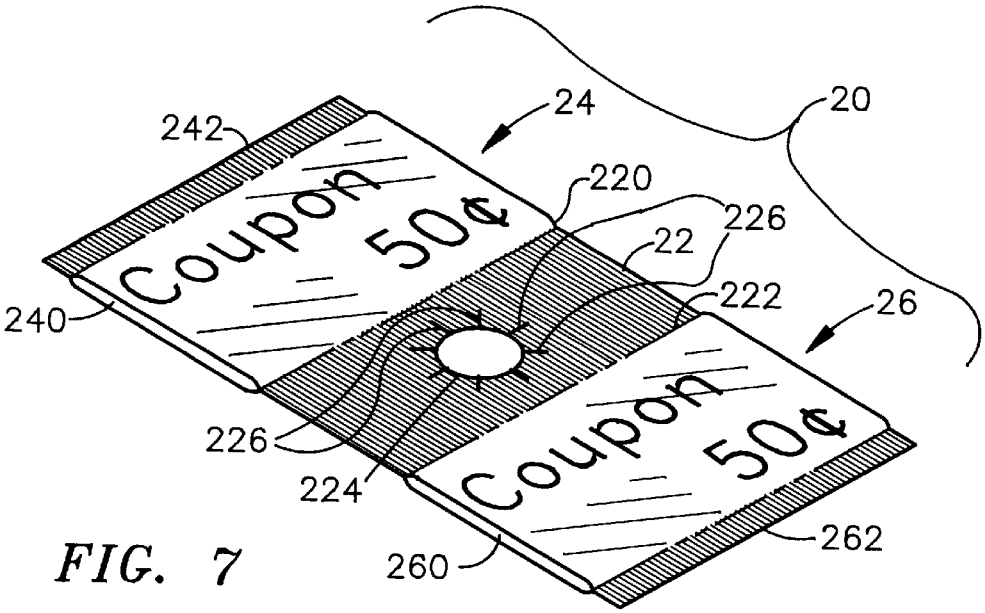
FIG. 7 is a perspective view of one embodiment of the promotional material display system for use with either the plastic jug or upright-type beverage containers shown in FIGS. 3–6.
Figure 8:
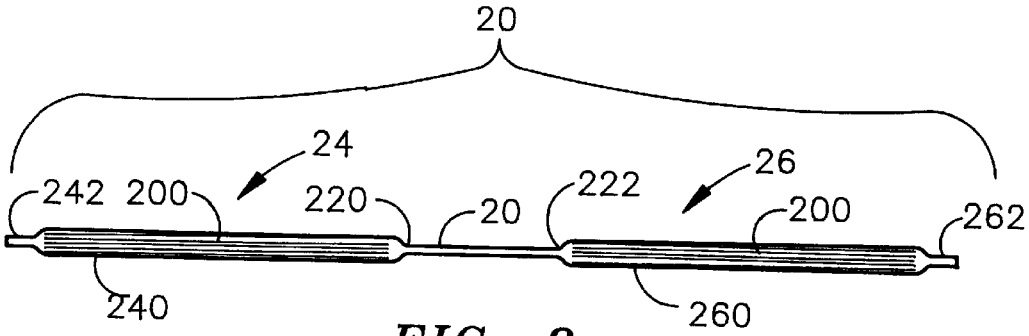
FIG. 8 is a side view of the promotional material display system embodiment of FIG. 7.

The present invention can also be extended to capped plastic beverage containers such as the standard jug-type container 300 shown in FIGS. 3 and 4 and the standard upright-type plastic beverage container 400 shown in FIGS. 5 and 6. One embodiment of the present invention suitable for use with the containers shown in FIGS. 3–6 is shown in a perspective view on FIG. 7 and in a side view in FIG. 8. Accordingly, like reference numerals will be used for those elements common in FIGS. 3–8. Promotional material display coupon packet assembly 20 includes central support section 22 and packets or envelopes 24 and 26 fixedly or detachably joined to central support section 22 along opposing edges 220 and 222. Similar to envelopes 14 and 16 in the previous embodiment, envelopes 24 and 26 have respective openings 240 and 260 for receiving therethrough one or more pieces of printed promotional material 200. Envelopes 24 and 26 could similarly be made from a transparent or opaque film material sealed or fused together along respective lower edges 242 and 262 to define the envelopes.

Figure 9:
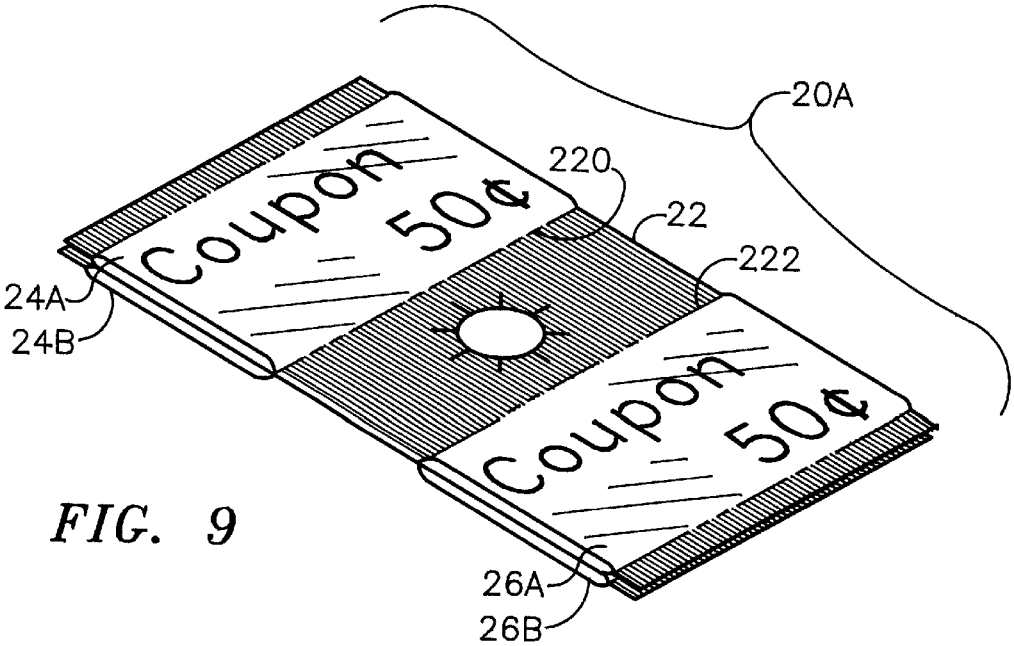
FIG. 9 is a perspective view of another embodiment of a promotional material display system according to the present invention that provides multiple promotional material holding envelopes on either side of the display system's central support.

Central support section 22 is typically made from a material, e.g, the same film material used to form envelopes 24 and 26, that lends itself to deformation. More specifically, hole 224 is provided in a central portion of central support section 22 for passing the cap (e.g., cap 302 in FIGS. 3 and 4 or cap 402 in FIGS. 5 and 6) and then engaging the neck (e.g., neck 304 in FIGS. 3 and 4 or neck 404 in FIGS. 5 and 6) of a capped container such as shown in FIGS. 3–6. Central support section 22 can include a plurality of slits 226 that extend radially away from hole 224 to facilitate the deformation and collapsing of hole 224 as central support section 12 is pressed over the cap for engagement with the neck of a capped beverage container. As in the first embodiment, promotional material display 20 does not extend beyond the container's footprint defined by the largest horizontal cross-section of the container (FIGS. 4 and 6). FIG. 9 presents a perspective view of a variation on promotional material display 20. More specifically, promotional material display 20A has multiple envelopes, represented by envelopes 24A, 24B and 26A, 26B fixedly or detachably depending from opposing edges 220 and 222 of central support section 20.

As seen in FIGS. 3 to 6, the beverage containers 300 and 400 have top parts whose cross-sectional areas are substantially the same as the cross sectional area of the bottom parts and with sides that extend in a substantially vertical direction.

Figure 10:
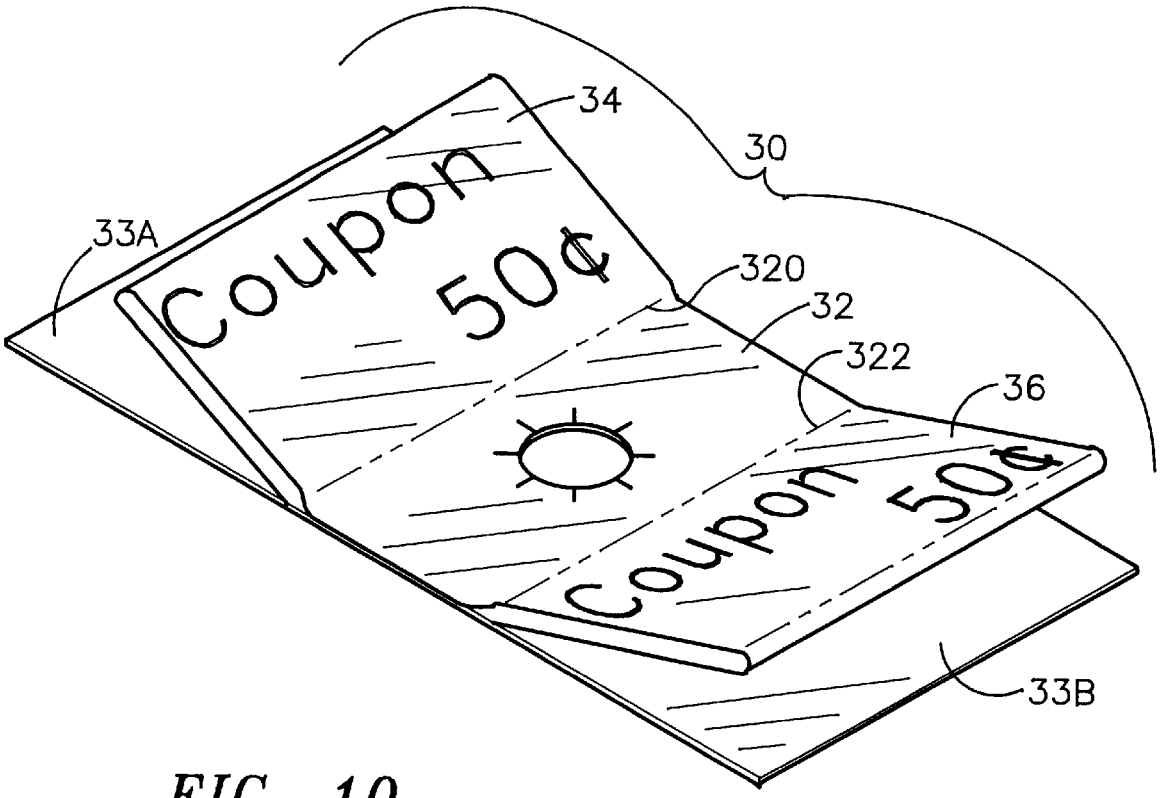
FIG. 10 is a perspective view of still another embodiment of a promotional material display system according to the present invention.
Figure 11:
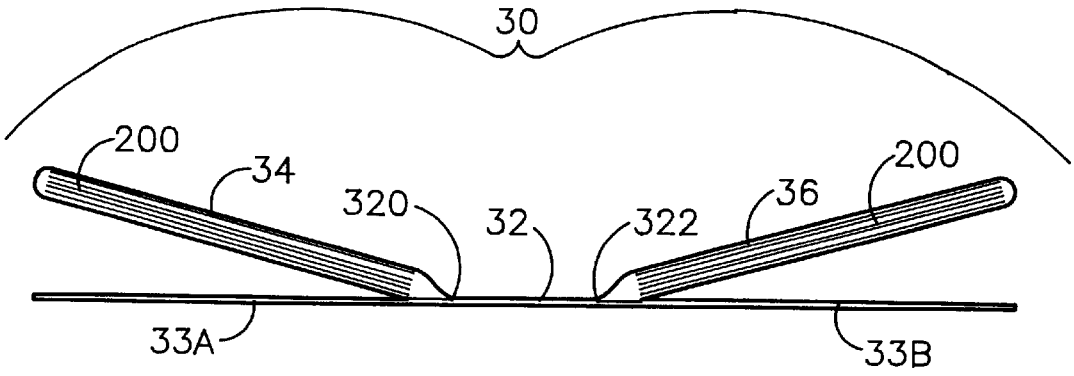
FIG. 11 is a side view of the embodiment of FIG. 10.
Figure 12:
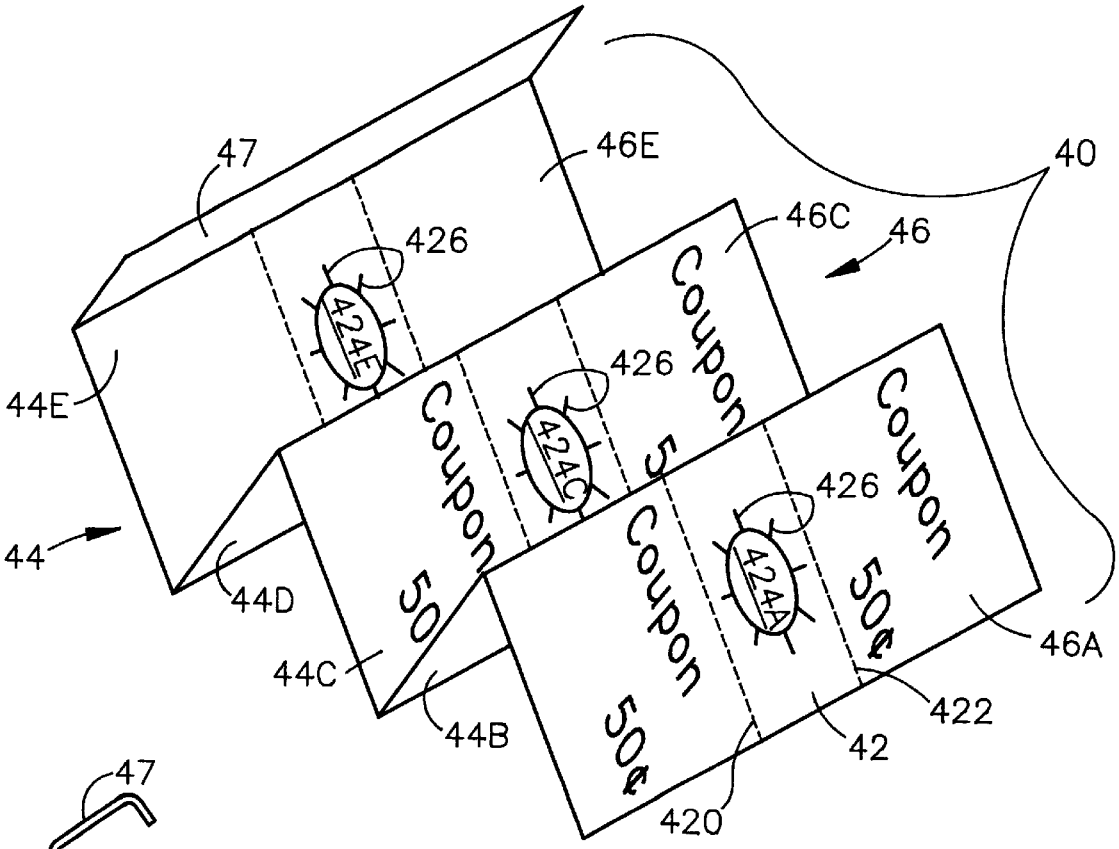
FIG. 12 is a perspective view of yet another embodiment of a promotional material display system according to the present invention in which the promotional material is integral with the carrier sections disposed on either side of the central support and in which the entire display system is accordion folded.
Figure 13:
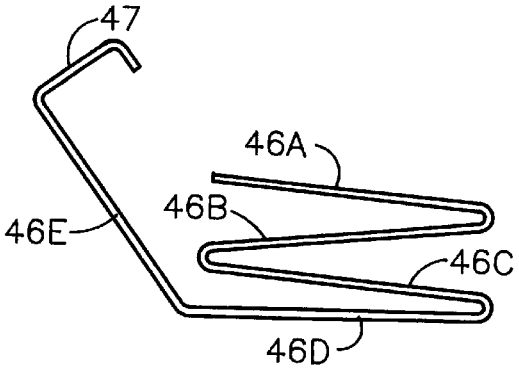
FIG. 13 is a side view of the embodiment of FIG. 12 as it is being folded.
Figure 14:
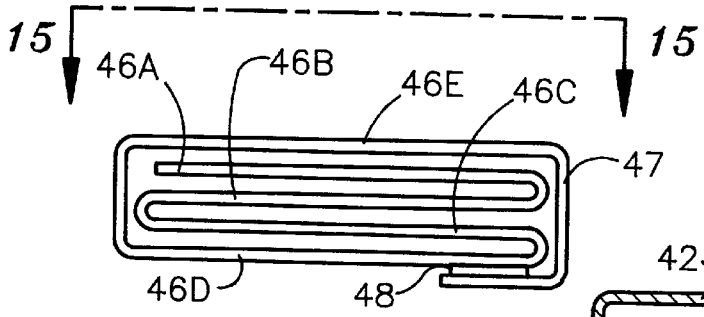
FIG. 14 is a side view of the embodiment of FIG. 12 in its folded position.

In FIGS. 10 and 11, promotional material display 30 includes central support section 32, side sections 33A and 33B, and packets or envelopes 34 and 36 detachably joined to central support section 32 along opposing edges 320 and 322. Central support section 32 along with side sections 33A and 33B form a planar carrier panel for displaying envelopes 34 and 36 in a substantially horizontal fashion when display 30 is engaged with the top of a container as described above. Each of envelopes 34 and 36 typically contain one or more pieces of printed promotional material 200.

Figure 15:
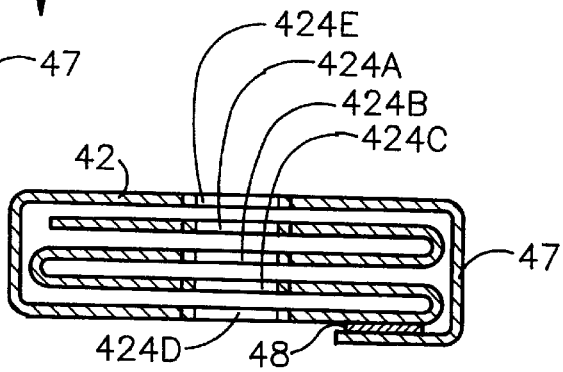
FIG. 15 is a cross-sectional view taken along line 15—15 of FIG. 14.

As mentioned above, the printed promotional material can be made integral with the display's central support section and can further be printed directly on a carrier as opposed to being placed in an envelope. This variation of the present invention for use with the jug-type or upright-type beverage containers is presented in two embodiments in FIGS. 12–18. In FIGS. 12–15, promotional material display 40 includes central support section 42 with printed promotional material carrier sections 44 and 46 detachably joined to opposing edges 420 and 422 of central support section 42. Each of carrier sections 44 and 46 can include a plurality of detachably joined pieces of promotional material designated 44A, . . . , 44E and 46A, 46E. Central support section 42 is provided with a plurality of holes 424A, 424B, 424C, 424D and 424E which, when display 40 is accordion folded transverse to central support section 42, are aligned with one another as best seen in FIG. 15. This causes the pieces of promotional material to be balanced on either side of the aligned holes. As with previous embodiments, the holes in central section 42 can be provided with slits 426 to facilitate engagement with a cap and neck of a beverage container as explained above. To insure that promotional material display 40 does not open accidentally, extension flap 47 wraps around the accordion-folded promotional material and central support section and may be tacked in place by glue tack 48.

Figure 16:
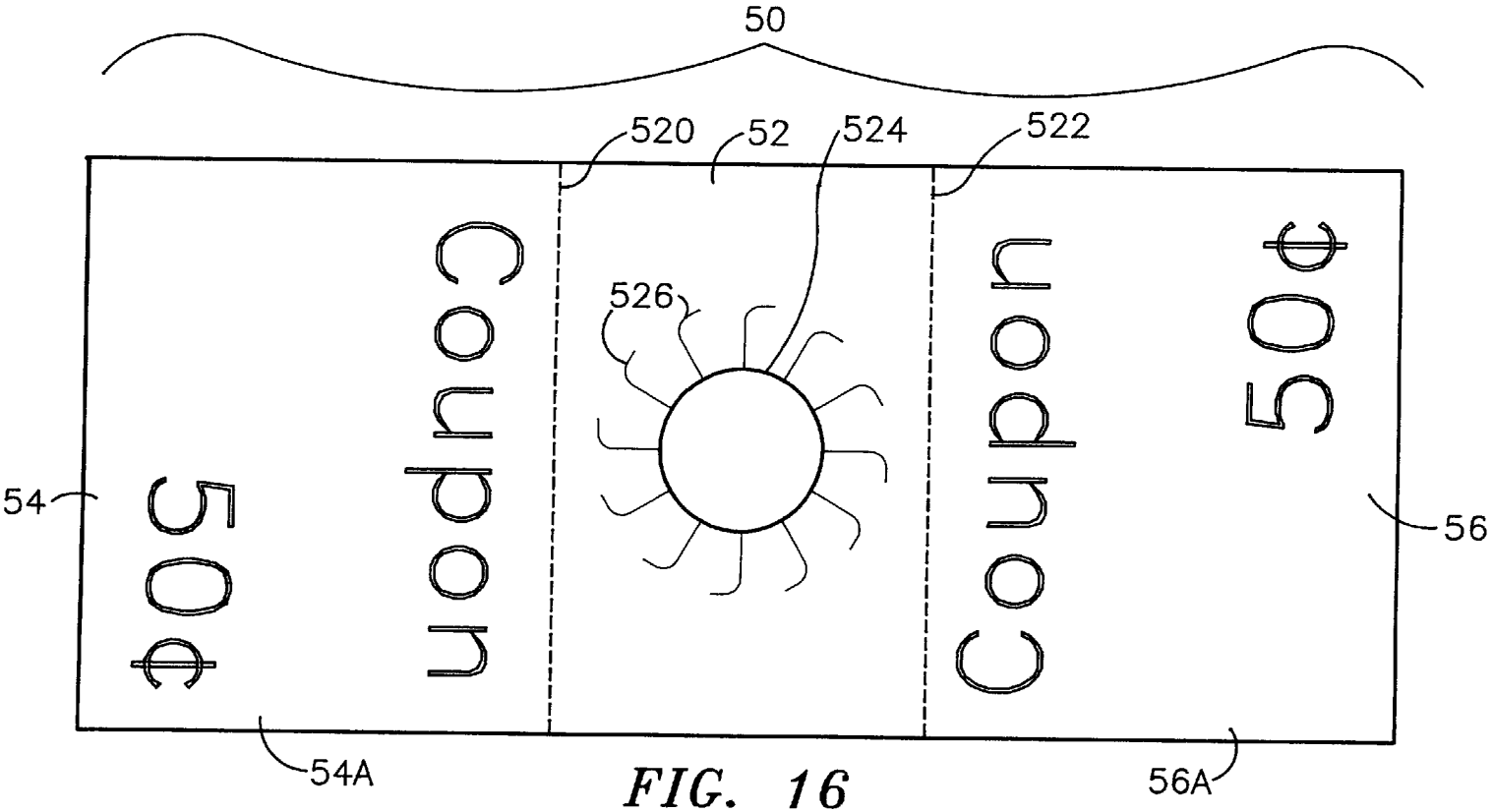
FIG. 16 is a top, planar view of still another embodiment of a promotional material display system according to the present invention in which the promotional material is integral with the carrier sections disposed on either side of the central support, and in which each of the carrier sections is roll-folded in toward the central support.
Figure 17:
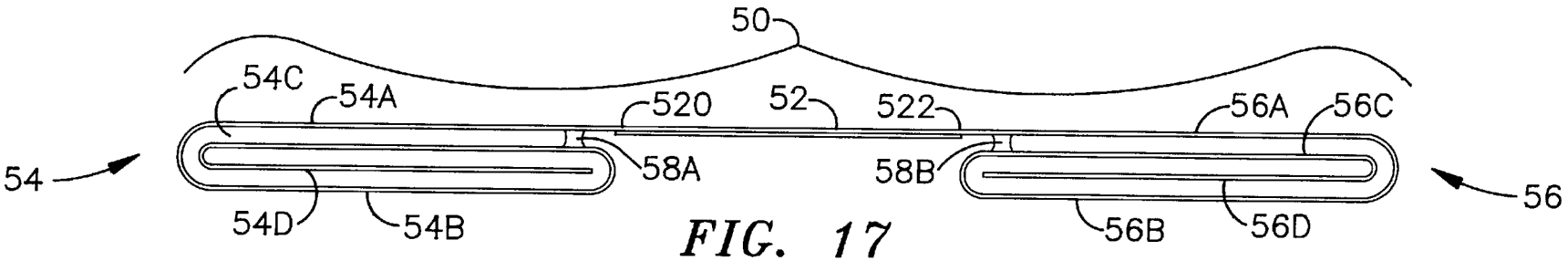
FIG. 17 is a side view of the embodiment of FIG. 16.
Figure 18:
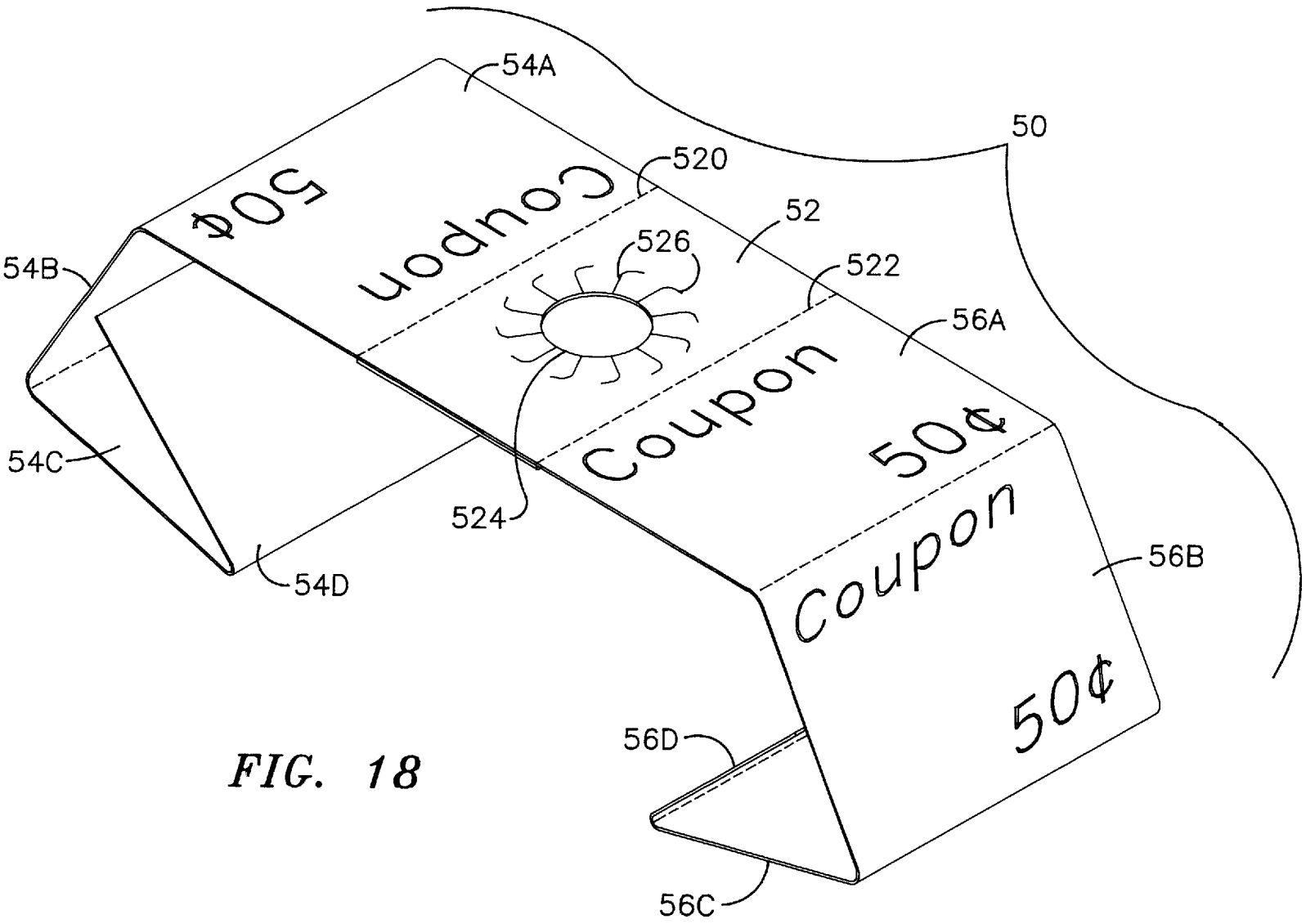
FIG. 18 is a perspective view of the embodiment of FIG. 16 showing the carrier sections partially unfolded.

In FIGS. 16–18, promotional material display 50 once again includes central support section 52 having hole 524 and slits 526, and carrier sections 54 and 56 detachably joined along respective opposing edges 520 and 522 of central support section 52. Each of carrier sections 54 and 56 is a plurality detachably joined pieces of promotional material designated 54A, . . . , 54D and 56A, . . . 56D. These promotional pieces are folded in a bed-roll fashion until only one piece 54A and 56A appears on either side of display 50. Once again, the present invention is balanced about its central support section. The folded position can be maintained, for example, by the use of glue tacks 58A and 58B as shown in FIG. 17. The advantage of this embodiment is that the promotional material can be opened without removing the display system from the container on which it is mounted.

The advantages of the present invention are numerous. A balanced, highly visible promotional material display system is presented for use with a variety of food and beverage containers. Further, the promotional material display system does not infringe on the stock space of any adjacent container. The present invention also provides a variety of embodiments for distributing a multiplicity of pieces of promotional material from the same display system. The present invention can be implemented by printing the promotional material directly on carrier sections balanced on either side of the system's central support or it can be implemented by providing envelopes on either side of the system's central support to hold the promotional material.

Thus, although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A coupon delivery system, comprising:

a beverage container that has sides, a bottom part having a cross-sectional area, a top part of substantially the same cross-sectional area as said bottom part, a centrally located neck with a capped spout and said container having a footprint which is the largest horizontal cross-section of said container when said container is upright;

a substantially rectangular coupon packet assembly having two similar opposed ends made of film having:

a central support section with said two ends extending therefrom;

a hole in a central part of said central support section surrounding said centrally located neck of said beverage container with said two ends hanging on opposite sides of said neck;

two generally flat envelopes with said envelopes located at said opposed ends of said coupon packet assembly with said two envelopes and said two ends hanging adjacent to the top part and entirely within said footprint and not extending down said beverage container sides and not adhered to said beverage container; and a multiplicity of coupons in each of said envelopes.

* * * * *